US009757001B2

(12) United States Patent
Hwang et al.

(10) Patent No.: US 9,757,001 B2
(45) Date of Patent: Sep. 12, 2017

(54) VACUUM CLEANER

(71) Applicant: LG ELECTRONICS INC., Seoul (KR)

(72) Inventors: Mantae Hwang, Seoul (KR); Philjae Hwang, Seoul (KR); Jaeheon Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 70 days.

(21) Appl. No.: 14/814,067

(22) Filed: Jul. 30, 2015

(65) Prior Publication Data

US 2016/0051109 A1 Feb. 25, 2016

(30) Foreign Application Priority Data

Aug. 21, 2014 (KR) ..... 10-2014-0108997

(51) Int. Cl.

| | |
|---|---|
| ***A47L 5/24*** | (2006.01) |
| ***A47L 9/28*** | (2006.01) |
| ***A47L 5/22*** | (2006.01) |
| ***A47L 5/28*** | (2006.01) |

(52) U.S. Cl.

CPC ..... *A47L 9/2873* (2013.01); *A47L 5/225* (2013.01); *A47L 5/24* (2013.01); *A47L 5/28* (2013.01); *A47L 9/2884* (2013.01)

(58) Field of Classification Search

CPC ... A47L 5/24; A47L 5/28; A47L 5/225; A47L 9/2873; A47L 9/2884

USPC ..... 15/328, 339, DIG. 1

See application file for complete search history.

(56) References Cited

U.S. PATENT DOCUMENTS

2010/0242209 A1 9/2010 Beskow et al.

FOREIGN PATENT DOCUMENTS

| | | | |
|---|---|---|---|
| JP | 2001149289 | A | 6/2001 |
| JP | 2002034871 | A | 2/2002 |
| JP | 2007075319 | A | 3/2007 |
| KR | 200165245 | Y1 | 2/2000 |
| KR | 200194997 | Y1 | 9/2000 |
| KR | 20010061439 | A | 7/2001 |
| KR | 20040025312 | A | 3/2004 |
| KR | 20110132196 | A | 12/2011 |
| WO | 2014123458 | A1 | 8/2014 |

*Primary Examiner* — David Redding

(74) *Attorney, Agent, or Firm* — Dentons US LLP

(57) ABSTRACT

A vacuum cleaner is provided. The vacuum cleaner includes: a cleaner main body including a nozzle assembly into which air including foreign substances is suctioned, a collecting portion that collects the suctioned foreign substances, a suction device that generates a suction force, and a battery for supplying power to the suction device; and a charging stand including support portions on which the cleaner main body is seated, and a battery charging portion for performing charging of a replacement battery.

18 Claims, 10 Drawing Sheets

VACUUM CLEANER

CROSS-REFERENCE TO RELATED APPLICATION(S)

This application claims priority under 35 U.S.C. §119 and 35 U.S.C. §365 to Korean Application No. 10-2014-0108997, filed in Korea on Aug. 21, 2014, whose entire disclosure is hereby incorporated by reference.

BACKGROUND

1. Field

A vacuum cleaner is disclosed herein.

2. Background

Vacuum cleaners are home appliances that suction air including foreign substances, such as dust, by using a suction force and discharge air from which the foreign substances are filtered in an inside of a main body, to an outside of the main body.

Such vacuum cleaners may be classified into manual cleaners directly operated by a user with the user's force and robotic cleaners that automatically perform cleaning while traveling an area to be cleaned by the user's manipulation.

In addition, the manual cleaners may be classified into wired cleaners that are connected to a power supply via an electrical wire and perform cleaning and wireless cleaners that perform cleaning in a wireless manner. Recently, wireless cleaners are widely used due to inconveniences of the electrical wire.

These vacuum cleaners may also be classified into canister type cleaners in which a main body and a suction nozzle are separated from each other and are connected using a connection pipe, and upright type cleaners in which a suction nozzle is combined with a main body.

These days, as a residential space is expanded and a living environment is changed, handy type cleaners, stick type cleaners or handy-stick type cleaners that are a combination of a handy type cleaner and a stick type cleaner, which are types of upright type wireless cleaners, are available in markets.

Wireless cleaners have a shape in which a battery for supplying power to a main body is built in a wireless cleaner and are configured to perform a cleaning task by charging the battery when power of the battery is consumed.

Meanwhile, Korean Patent Registration No. 10-1224595 discloses a handy-stick type vacuum cleaner. The prior art literature discloses the handy-stick type vacuum cleaner in which a dust collected state of an inside of a dust canister can be easily checked even while cleaning is performed.

The prior art literature discloses a configuration including a handy cleaner unit separably mounted on a rear surface of a main body and a configuration in which a battery is built in an inside of an auxiliary cleaner.

Also, the prior art literature discloses a configuration in which the main body is mounted on a charging device so that a connection terminal and a charging device terminal are connected to each other and if the connection terminal is connected to the charging device terminal, commercially available power is applied to the charging device terminal via an electrical wire and the applied power is used to charge the battery installed in an inside of the handy cleaner unit in a state in which the handy cleaner unit is mounted in a mounting space of the main body.

In this way, the prior art literature discloses a configuration in which charging is performed in a state in which the handy cleaner unit is mounted on the main body and a configuration in which the battery is installed in the inside of the handy cleaner unit. Thus, there is a limitation that it is inconvenient to charge the battery of the handy-stick type cleaner.

SUMMARY

The present invention is directed to a vacuum cleaner that is capable of being easily used and performing charging easily.

According to an aspect of the present invention, there is provided a vacuum cleaner including: a cleaner main body including a nozzle assembly into which air including foreign substances is suctioned, a collecting portion that collects the suctioned foreign substances, a suction device that generates a suction force, and a battery configured to supply power to the suction device; and a charging stand including support portions on which the cleaner main body is seated, and a battery charging portion configured to charge a replacement battery.

According to another aspect of the present invention, there is provided a vacuum cleaner including: a cleaner main body including a nozzle assembly into which air including foreign substances is suctioned, a collecting portion that collects the suctioned foreign substances, a suction device that generates a suction force, and a first battery that supplies power to the suction device; and a charging stand including support portions on which the cleaner main body is seated, and a battery charging portion configured to charge a second battery that is capable of being replaced with the first battery.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as "first," "second," "A," "B," "(a)," "(b)" or the like may be used herein when describing components of the present invention. Each of these terms is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
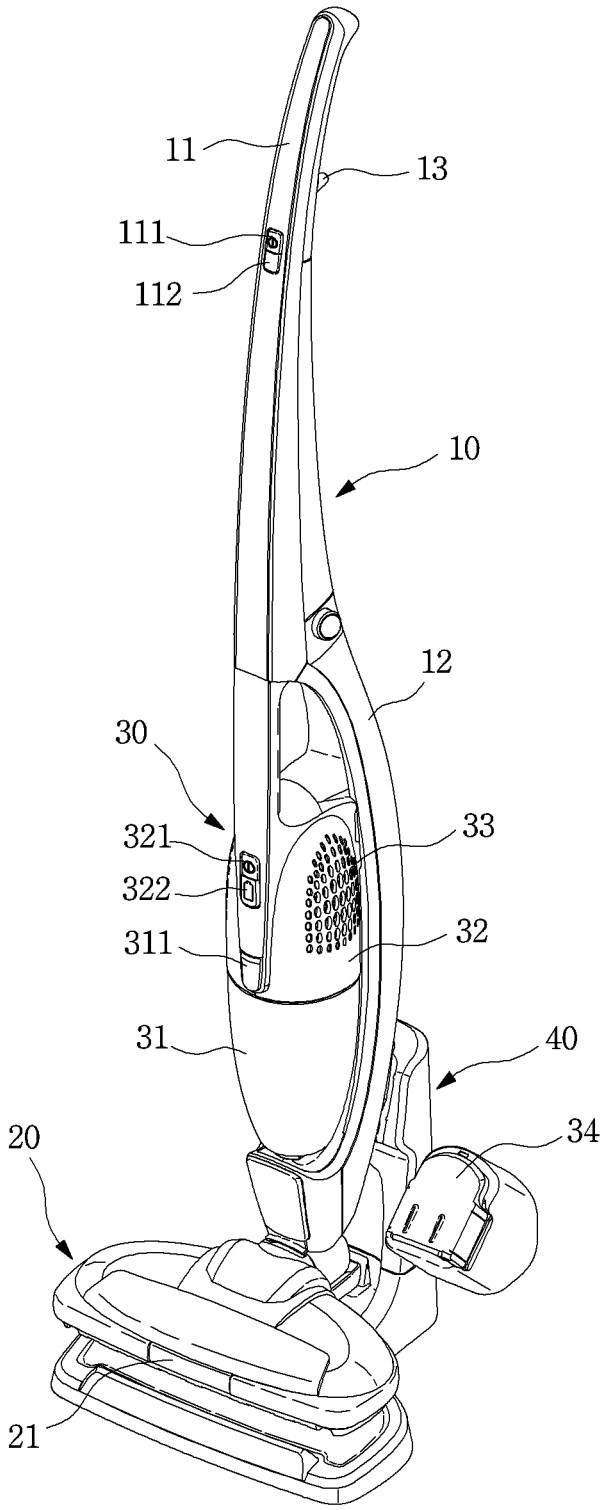
FIG. 1 is a perspective view illustrating a state in which a vacuum cleaner is supported by a charging stand, according to an embodiment.
Figure 2:
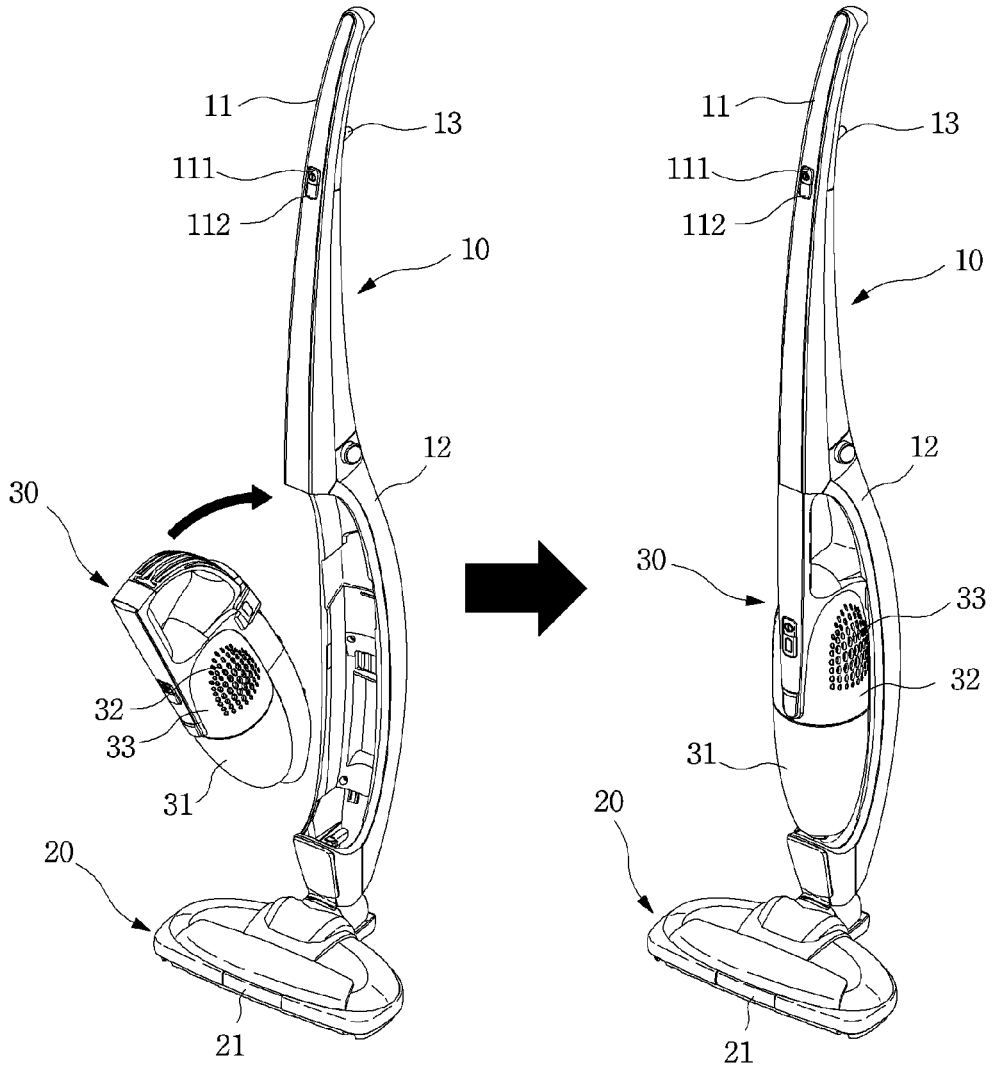
FIG. 2 is a perspective view illustrating a state in which a main body and an auxiliary cleaner are separated from each other in the vacuum cleaner according to an embodiment.
Figure 3:
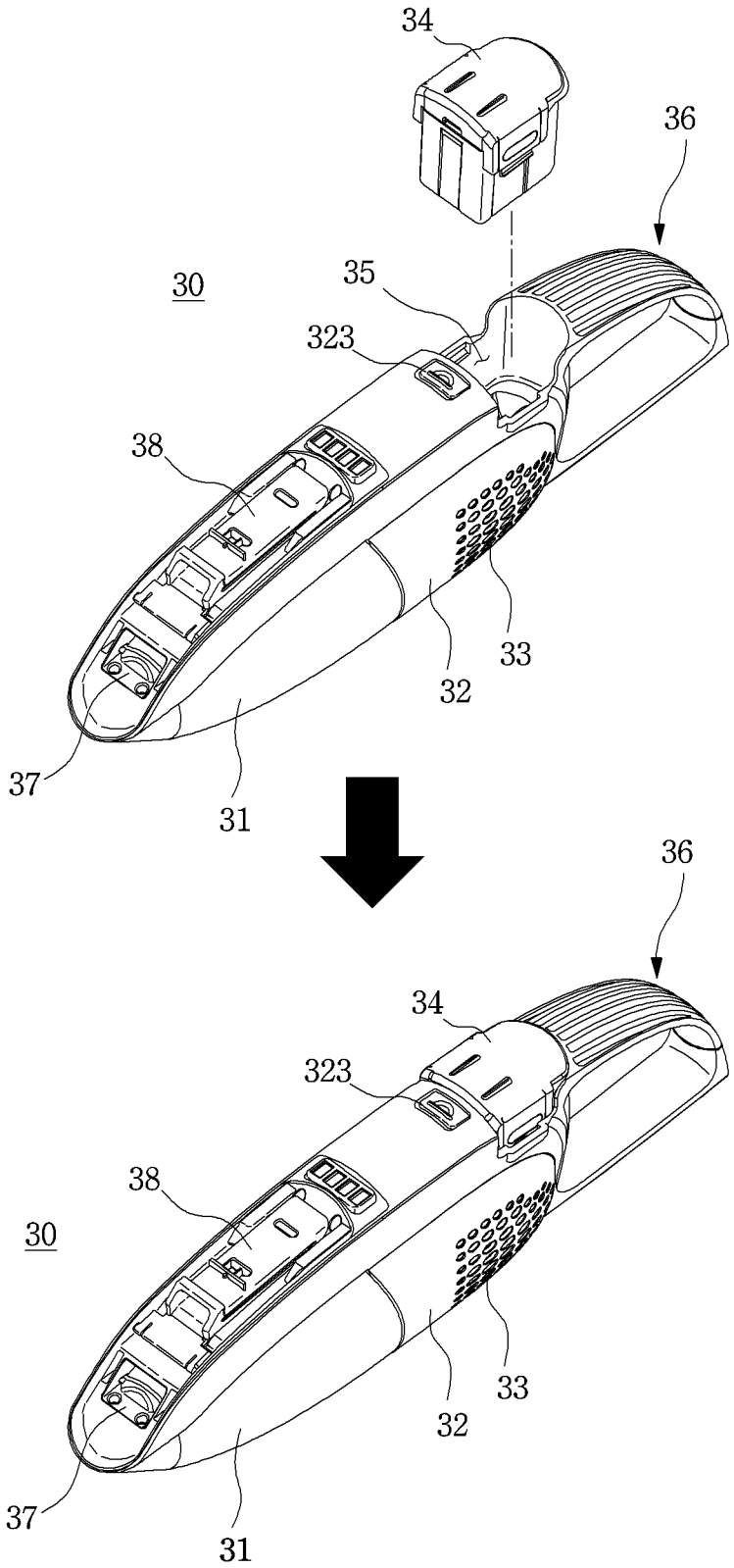
FIG. 3 is a perspective view illustrating a state in which a battery is mounted on the auxiliary cleaner of the vacuum cleaner according to an embodiment.

FIG. 1 is a perspective view illustrating a state in which a vacuum cleaner is supported by a charging stand, according to an embodiment, and FIG. 2 is a perspective view illustrating a state in which a main body and an auxiliary cleaner are separated from each other, in the vacuum cleaner according to an embodiment, and FIG. 3 is a perspective view illustrating a state in which a battery is mounted on the auxiliary cleaner of the vacuum cleaner according to an embodiment.

Referring to FIGS. 1 through 3, the vacuum cleaner according to an embodiment may include a cleaner main body 10 and a charging stand 40. The charging stand 40 has a configuration for performing charging of the cleaner main body 10. Thus, in the present invention, both the cleaner main body 10 and the charging stand 40 are referred to as a vacuum cleaner.

Also, the cleaner main body 10 may include a nozzle assembly 20 into which air including foreign substances is suctioned, a collecting portion 31 that collects the suctioned foreign substances, a suction device that generates a suction force in the cleaner main body 10, and a battery 34 separably mounted on the cleaner main body 10.

The cleaner main body 10 according to the present invention will now be described in detail. The cleaner main body 10 is formed long in a vertical direction and includes a main body handle 11 that is formed at an upper side of the cleaner main body 10 and may be gripped by a user to perform cleaning, and the nozzle assembly 20 connected to a lower side of the cleaner main body 10.

A finger hook 13 on which the user's finger may be hung so that the user may grip the main body handle 11 easily, is provided at the main body handle 11, and a main body power supply switch 111 through which the user may select the supply of power to operate the cleaner main body 10 is provided at the main body handle 11.

A main body control switch 112 through which the user may control a degree of an operation of the cleaner main body 10 is further provided at one side of the main body power supply switch 111.

The user hooks his/her own fingers on the finger hook 13 by gripping the main body handle 11 so that the cleaner main body 10 may be easily moved.

An accommodation portion 12 that accommodates an auxiliary cleaner 30 to be separated from the cleaner main body 10, is formed at a lower side of the cleaner main body 10, and the nozzle assembly 20 is connected to a bottom end of the cleaner main body 10.

The nozzle assembly 20 is rotatably connected to the bottom end of the cleaner main body 10 (hereinafter, referred to as a 'main body') and provides a path in which foreign substances on a surface to be cleaned by the user are suctioned together with surrounding air.

The nozzle assembly 20 is formed to have an entire shape of a rectangular plate having a predetermined internal space and is formed to suction the foreign substances together with the surrounding air into the internal space.

An illumination portion 21 that provides the user with illumination toward a front surface of the nozzle assembly 20, i.e., toward the front of the main body 10 is provided. The illumination portion 21 provides illumination when the nozzle assembly 20 is moved so that the user may identify the foreign substances on the surface to be cleaned even in a dark space.

In addition, illumination is provided by the illumination portion 21 when the user wants to perform a cleaning task in the dark space so that damage caused by an impact to the nozzle assembly 20 may be prevented.

The illumination portion 21 may include a light-emitting diode (LED) and is controlled to provide illumination when the user manipulates the main body power supply switch 111.

Although the illumination portion 21 is configured in any shape, the illumination portion 21 may be disposed at one surface of the nozzle assembly 20 so that illumination may be provided in a forward direction in which the user pushes and moves the main body 10.

Although not shown, a bottom surface suction port that provides the path in which the foreign substances on the surface to be cleaned by the user are suctioned together with the surrounding air, may be formed on a bottom surface of the nozzle assembly 20, and a brush may be rotatably mounted in an internal space of the nozzle assembly 20 so as to remove the foreign substances on the surface to be cleaned from the surface to be cleaned while making a rotational movement.

The auxiliary cleaner 30 is detachably accommodated in the accommodation portion 12. The auxiliary cleaner 30 is formed to be in communication with the nozzle assembly 20 while one end of the auxiliary cleaner 30 is in communication with the bottom end of the main body 10.

A terminal portion that electrically connects the main body 10 and the auxiliary cleaner 30 is provided at the accommodation portion 12, and a terminal portion to be electrically connected to the terminal portion provided at the accommodation portion 12 is provided at the auxiliary cleaner 30.

When the auxiliary cleaner 30 is accommodated in and mounted on the accommodation portion 12, the main body 10 and the auxiliary cleaner 30 are electrically connected to each other by the terminal portion.

The auxiliary cleaner 30 may include the collecting portion 31 in which the foreign substances separated from the air including the foreign substances suctioned from the nozzle assembly 20 are collected, and a suction device portion 32 which is disposed at one side of the collecting portion 31 and on which the suction device for generating a suction force in the auxiliary cleaner 30, is mounted.

The suction device mounted in an internal space of the suction device portion 32 includes a suction motor that generates rotary power by power applied to the main body 10, and a suction fan that generates a suction force by making a rotational movement by the rotation power supplied from the suction motor.

Discharge ports 33 may be provided at both sides of the suction device portion 32 so as to discharge the air from which the foreign substances are removed, to the outside, and a filter member for filtering the air from which the foreign substances are removed, again, may be further mounted in the discharge ports 33. Each of the discharge ports 33 may include a plurality of holes.

An auxiliary power supply switch 321 for turning on/off power of the auxiliary cleaner 30 may be provided in the center of the suction device portion 32, and a battery indicator 322 that indicates the remaining amount of a battery (34 of FIG. 3) that will be described below or whether the battery is mounted, may be provided at one side of the auxiliary power supply switch 321. Also, a separation button 311 for separating the collecting portion 31, is provided at one side of the battery indicator 322.

Referring to FIG. 3, a battery compartment 35 that provides a space in which the battery 34 for supplying power to the suction device is mounted, is formed in one side of the suction device portion 32 of the auxiliary cleaner 30.

The battery 34 is separably mounted in the battery compartment 35 so that a used battery 34 may be separated from the auxiliary cleaner 30 and the battery 34, after charging of which is finished, may be mounted in the battery compartment 35 and may supply power to the suction device.

A battery button 323 through which the battery 34 is detached from or attached to the battery compartment 35 is provided at one side of the battery compartment 35. The user manipulates the battery button 323 to separate the battery 34 from the battery compartment 35.

An auxiliary suction port 37 that provides a suction path of air that flows from the nozzle assembly 20 and the foreign substances is formed at an end of the auxiliary cleaner 30, and an auxiliary handle 36 through which the user grips the auxiliary cleaner 30 when the user wants to use the auxiliary cleaner 30, is provided at the other and of the auxiliary cleaner 30.

Hereinafter, a configuration of the charging stand 40 of the vacuum cleaner according to an embodiment will be described.

Figure 4:
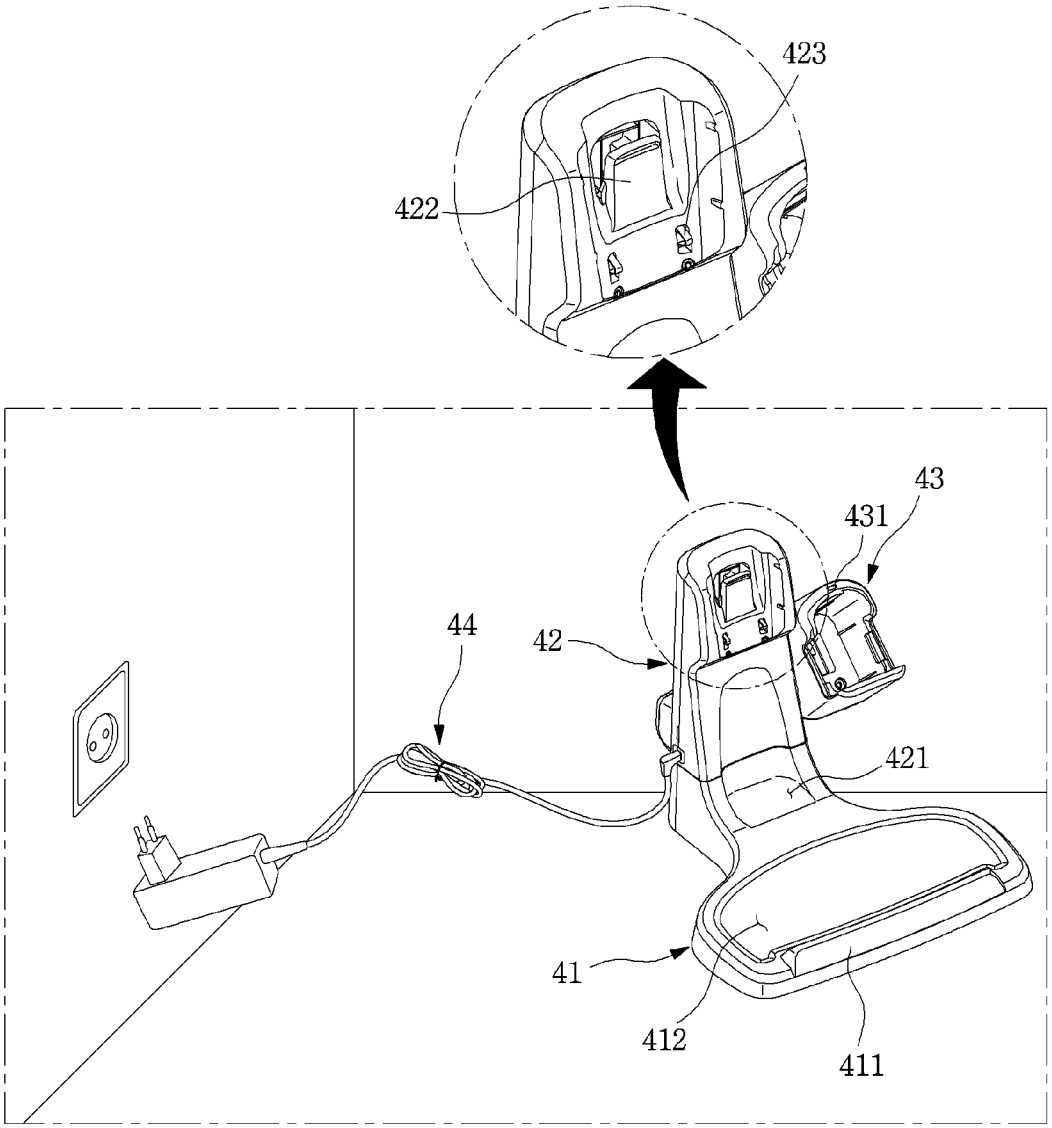
FIG. 4 is a left perspective view illustrating a configuration of the charging stand of the vacuum cleaner according to an embodiment.
Figure 5:
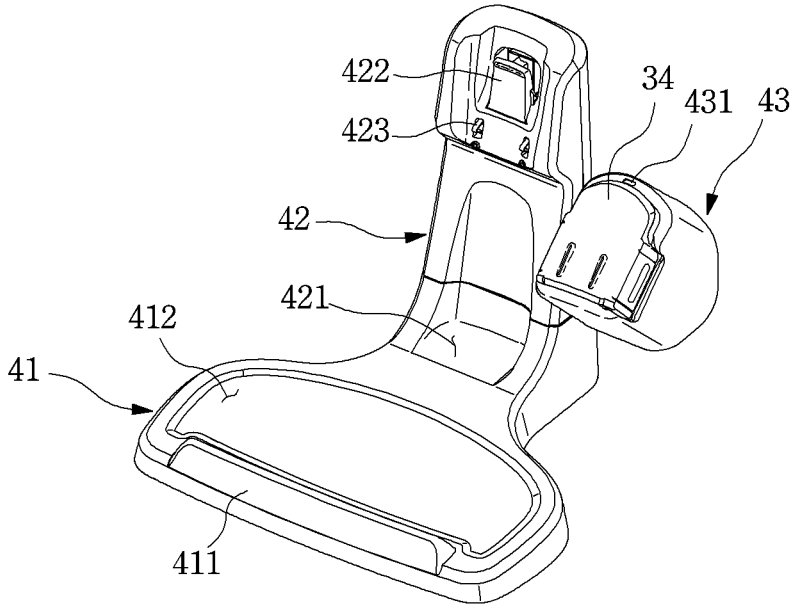
FIG. 5 is a right perspective view illustrating a configuration of the charging stand of the vacuum cleaner according to an embodiment.

FIG. 4 is a left perspective view illustrating a configuration of the charging stand of the vacuum cleaner according to an embodiment, and FIG. 5 is a right perspective view illustrating a configuration of the charging stand of the vacuum cleaner according to an embodiment.

Figure 6:
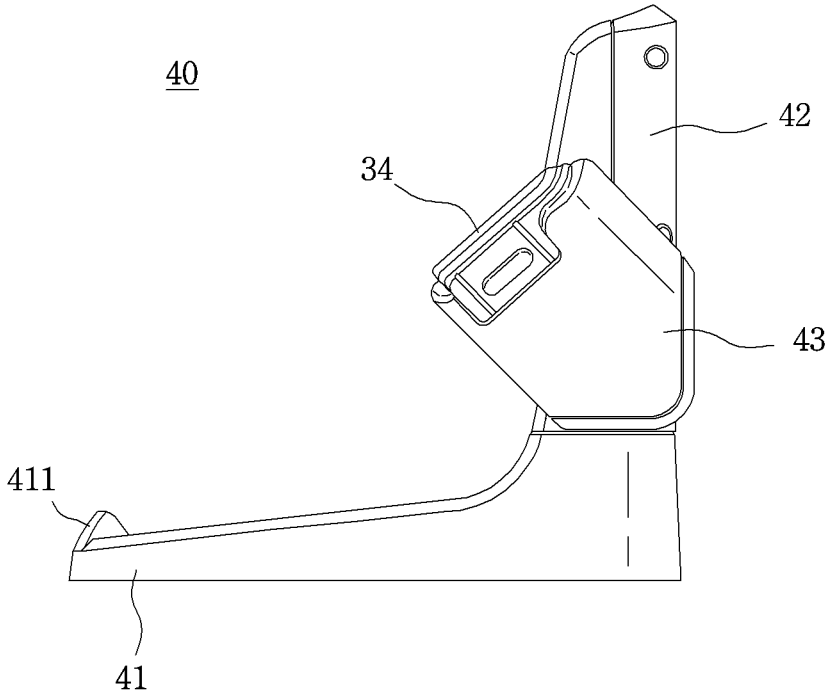
FIG. 6 is a right side view illustrating a configuration of the charging stand of the vacuum cleaner according to an embodiment.
Figure 7:
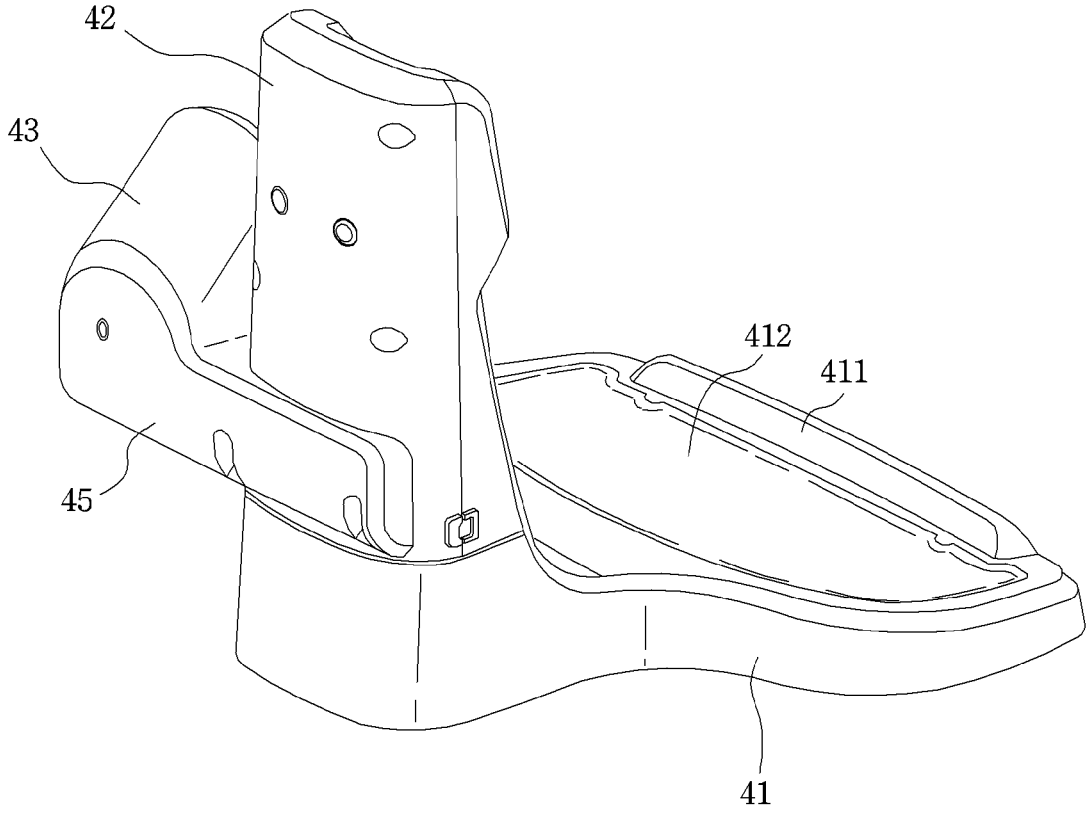
FIG. 7 is a rear perspective view illustrating a configuration of the charging stand of the vacuum cleaner according to an embodiment.

In addition, FIG. 6 is a right side view illustrating a configuration of the charging stand of the vacuum cleaner according to an embodiment, and FIG. 7 is a rear perspective view illustrating a configuration of the charging stand of the vacuum cleaner according to an embodiment.

Referring to FIGS. 4 through 7, the charging stand 40 for performing charging of the battery 34 may include support portions 41 and 42 that support the main body 10, a battery charging portion 43 that is disposed at one side of each of the support portions 41 and 42 and charges the battery 34, and an adapter 44 that supplies power to the support portions 41 and 42 and the battery charging portion 43.

The support portions 41 and 42 may include a nozzle support portion 41 on which the nozzle assembly 20 is seated and supported, and a main body support portion 42 that supports the main body 10.

The nozzle support portion 41 is formed in an entire shape of a plate having a predetermined thickness and supports the nozzle assembly 20 at a lower side of the nozzle assembly 20 when the nozzle assembly 20 is disposed on and seated on a top surface of the nozzle support portion 41.

A seating portion 412 having a shape corresponding to a bottom surface of the nozzle assembly 20 is formed in the top surface of the nozzle support portion 41 to be recessed downward, and a nozzle stopper 411 for restricting movement of the nozzle assembly 20 is formed at a front end of the nozzle support portion 41 to be protruded upward.

The nozzle assembly 20 may be stably supported by the seating portion 412.

The nozzle stopper 411 is formed at the front end of the nozzle support portion 41 long in a left/right direction and protrudes upward to have a predetermined height. Forward movement of the nozzle assembly 20 in a state in which the nozzle assembly 20 is disposed on the top surface of the nozzle support portion 41, may be restricted by the nozzle stopper 411.

That is, although the user does not sit the nozzle assembly 20 on the seating portion 412, the nozzle assembly 20 is disposed on the top surface of the nozzle support portion 41, and forward movement of the nozzle assembly 20 is restricted by the nozzle stopper 411 so that the nozzle assembly 120 may be naturally positioned on the seating portion 412 and the main body 10 may be easily supported.

The main body support portion 42 has a shape of a plate that is long in the vertical direction while having a predetermined width and is configured so that a bottom end of the main body support portion 42 may be connected to a rear end of the nozzle support portion 41.

Of course, the main body support portion 42 may be formed integrally with the nozzle support portion 41 or may be formed to be separated from the nozzle support portion 41 so that the charging stand 40 may be formed by coupling the main body support portion 42 and the nozzle support portion 41.

A main body seating portion 421 on which the bottom end of the main body 10 is seated, is formed at a portion in which the bottom end of the main body support portion 42 and the rear end of the nozzle support portion 41 are connected to each other. The main body seating portion 421 is formed in such a way that a predetermined part of the bottom end of the main body 10 may be accommodated in the main body seating portion 421 and the main body 10 may be stably supported.

Also, a main body coupling portion 422 for coupling the main body support portion 42 to the main body 10 is provided at the main body support portion 42. The main body coupling portion 422 is coupled to coupling grooves formed in one surface of the main body 10 when a part of the main body support portion 42 is formed to protrude forward.

In this way, when the main body coupling portion 422 is coupled to the main body 10, the main body 10 may be stably supported on the charging stand 40.

A terminal portion 423, to which the main body 10 is coupled to electrically connect the main body 10 and the charging stand 40, is provided at one side of the main body coupling portion 422, and a terminal portion is also provided at the main body 10 corresponding to the terminal portion 423, and when the main body 10 is supported on the charging stand 40, the main body 10 and the charging stand 40 may be electrically connected to each other by the terminal portion 423.

A power supply terminal that connects a commercially available power supply is formed at one side of the charging stand 40, and the power supply terminal and the commercially available power supply are connected to each other by the adapter 44 so that commercially available power may be supplied to the charging stand 40.

When the commercially available power is supplied to the charging stand 40 by the adapter 44, power is applied to the terminal portion 423, and when the main body 10 is seated on and supported by the charging stand 40, the terminal portion 423 and the main body 10 are electrically connected to each other.

The main body 10 and the terminal portion 423 are electrically connected to each other so that a battery mounted in the main body 10 may be charged.

The terminal portion 423 simultaneously performs a function of determining a state in which the main body 10 is mounted on the charging stand 40, i.e., whether the main body 10 is mounted on the charging stand 40.

This is because, when the main body 10 is mounted on the charging stand 40, the terminal portion 423 is electrically connected to the main body 10 and a current flows through the terminal portion 423, and due to the flow of the current, the terminal portion 423 may determine a state in which the main body 10 is mounted on the charging stand 40.

In other words, in a state in which the main body 10 is not mounted on the charging stand 40, the terminal portion 423 is not connected to the main body 10 so that a flow of the current is cut, and when the main body 10 is mounted on the charging stand 40, the terminal portion 423 is connected to the main body 10, and a current flows through the terminal portion 423 so that the flow of the current caused by the terminal portion 423 may be checked and the terminal portion 423 may determine whether the main body 10 is mounted on the charging stand 40.

In this way, the flow of the current caused by connection of the terminal portion 423 is checked so that it may be determined whether the main body 10 is mounted on the charging stand 40. Thus, a separate detection device for detecting whether the main body 10 is mounted on the charging stand 40 is unnecessary so that the number of components can be reduced. Connection of the separate detection device is unnecessary so that assembly characteristics and productivity can be improved.

The battery charging portion 43 for performing charging of the battery 34 is provided at one side of the main body support portion 42. The battery charging portion 43 is formed in a shape of a box having an entire internal space, and in the drawings, a top surface of the battery charging portion 43 is open so that the battery 34 may be inserted into and detached from the battery charging portion 43.

An inside of the internal space of the battery charging portion 43 is formed to correspond to an outer surface of the battery 34 so that, when the battery 34 is inserted into the internal space of the battery charging portion 43, insertion of the battery 34 may be easily performed.

In addition, hook-shaped charging coupling portions for preventing the battery 34 from being arbitrarily detached from the battery charging portion 43 are provided at the battery charging portion 43 and the battery 34. The battery 34 may be prevented from being arbitrarily detached from the battery charging portion 43 by the hook-shaped charging coupling portions.

Of course, the charging coupling portions may not have a hook shape but may have an interlocking shape of a protrusion and a groove or a combination of protrusions, and by coupling the charging coupling portions, the battery 34 may be prevented from being arbitrarily detached from the battery charging portion 43.

In the embodiment of the present invention, a configuration of the hook-shaped charging coupling portions will be described. When the charging coupling portions are formed at the battery charging portion 43 and the battery 34, a member for releasing the coupling of the charging coupling portions may also be provided at the battery 34 or the battery charging portion 43.

That is, when the charging coupling portions are formed in a hook shape, in order to release coupling of the charging coupling portions, the hook-shaped charging coupling portions are compressed and coupling thereof is released. When the charging coupling portions are formed in a different shape, a button through which coupling of the charging coupling portions is released, may also be further provided.

A charge indicator 431 that indicates a degree of charge of the battery 34 is further provided at the battery charging portion 43. The charge indicator 431 is provided in a shape of a lamp having a predetermined brightness. The charge indicator 431 is turned on with a different color or different brightness according to the charge level of the battery 34 so that the user may recognize the charge level of the battery 34.

A battery terminal for electrically connecting the battery 34 is provided at the battery charging portion 43, and when the battery 34 is mounted on the battery charging portion 43, a predetermined voltage is generated. As the voltage is generated, it may be determined whether the battery 34 is mounted on the battery charging portion 43.

That is, when the battery 34 is mounted on the battery charging portion 43, a battery terminal is connected to the battery 34 so that a predetermined voltage may be generated. It is determined by the voltage whether the battery 34 is mounted on the battery charging portion 43 so that a separate detection device is unnecessary.

In this way, it is determined whether the main body 10 and the battery 34 are mounted on the charging stand 40, in a state in which no separate detection device is provided at the charging stand 40.

A configuration for determining whether the main body 10 and the battery 34 are mounted on the charging stand 40 will be described below.

Although not shown, a battery storing portion for storing the battery 34 may be further provided at the support portions 41 and 42. This is to prepare for a case where a plurality of batteries 34 are provided, or to accommodate and store the battery 34, after the charging of which is finished. In this way, the battery storing portion is formed so that storing of the battery 34 may be easily performed.

Referring to FIG. 6, the top surface of the nozzle support portion 41 is formed to be inclined downward at a predetermined angle toward the forward direction. In this way, when the top surface of the nozzle support portion 41 is formed to be inclined downward at the predetermined angle, the nozzle assembly 20 may be easily moved forward along the top surface of the nozzle support portion 41.

When the nozzle assembly 20 is moved, forward movement of the nozzle assembly 20 is restricted by the nozzle stopper 411 formed at the front end of the nozzle support portion 41 so that the main body 10 may be moved downward and may be coupled to the main body coupling portion 422.

Referring to FIG. 7, the main body support portion 42 and the battery charging portion 43 are connected to each other by a connection beam 45. The connection beam 45 has a shape of a plate having a predetermined internal space and is mounted to connect a rear surface of the main body support portion 42 and a rear surface of the battery charging portion 43.

The main body support portion 42 and the battery charging portion 43 are connected by the connection beam 45, and an electrical wire is accommodated in the internal space of the connection beam 45 so that the main body support portion 42 and the battery charging portion 43 may be electrically connected to each other.

That is, the commercially available power is supplied to the charging stand 40 by connection of the adapter (44 of FIG. 8), and the commercially available power supplied to the charging stand 40 is supplied to the terminal portion 423 and the battery charging portion 43.

In this case, the commercially available power is supplied to the battery charging portion 43 by the electrical wire built in the connection beam 45. The power supplied to the battery charging portion 43 is connected to the battery terminal and may be used to charge the battery 34 mounted on the battery charging portion 43.

Figure 8:
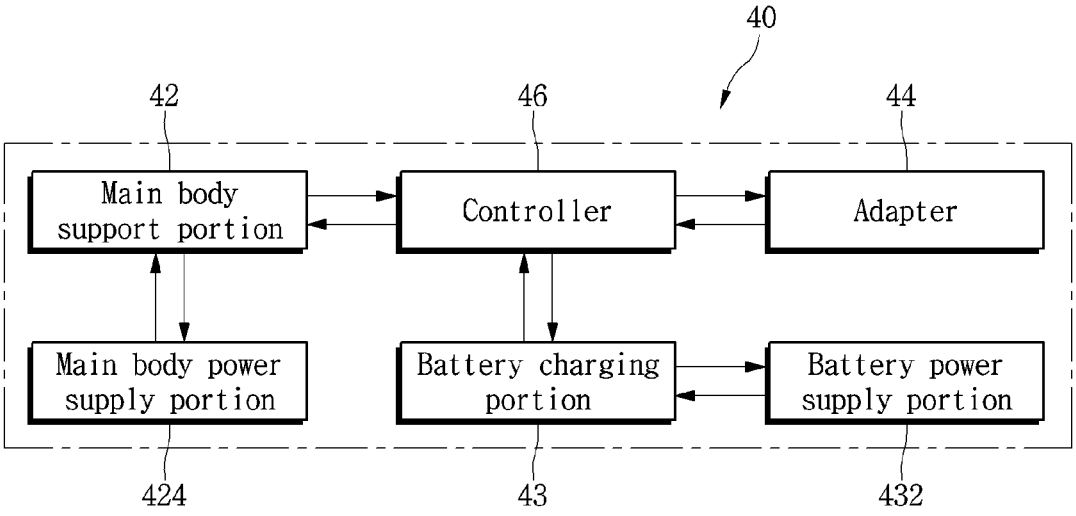
FIG. 8 is a block diagram illustrating a configuration of the charging stand of the vacuum cleaner according to an embodiment.
Figure 9:
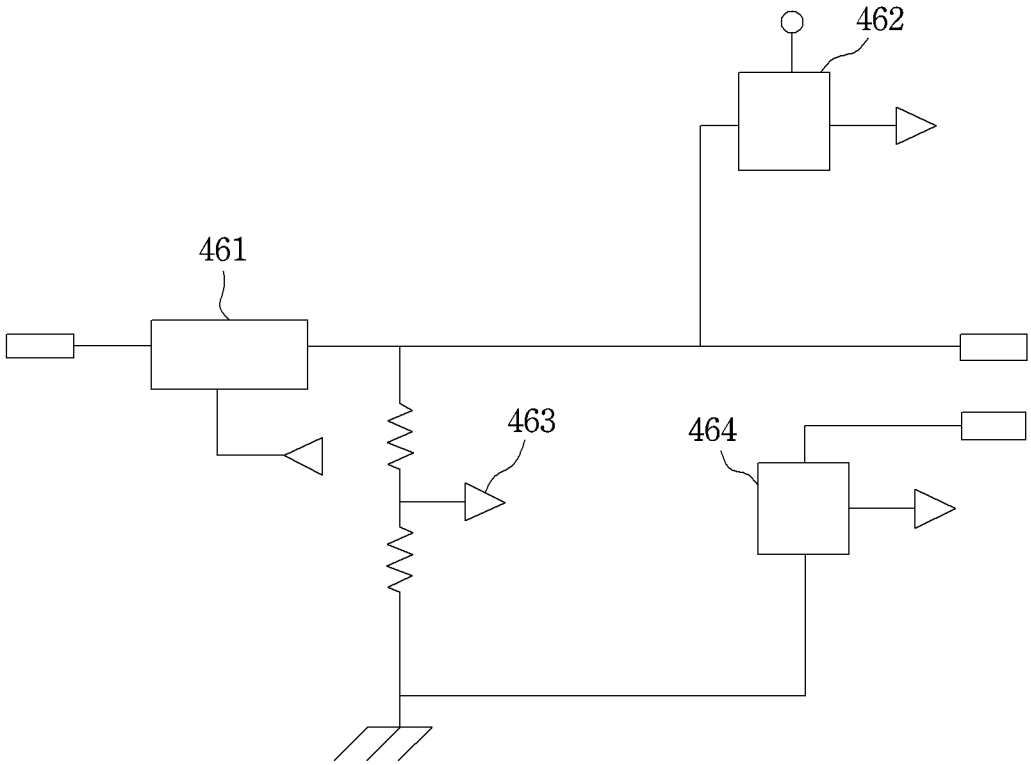
FIG. 9 is a partial circuit diagram illustrating a part of a circuit of the charging stand of the vacuum cleaner according to an embodiment.

FIG. 8 is a block diagram illustrating a configuration of the charging stand of the vacuum cleaner according to an embodiment, and FIG. 9 is a partial circuit diagram illustrating a part of a circuit of the charging stand of the vacuum cleaner according to an embodiment.

Figure 10:
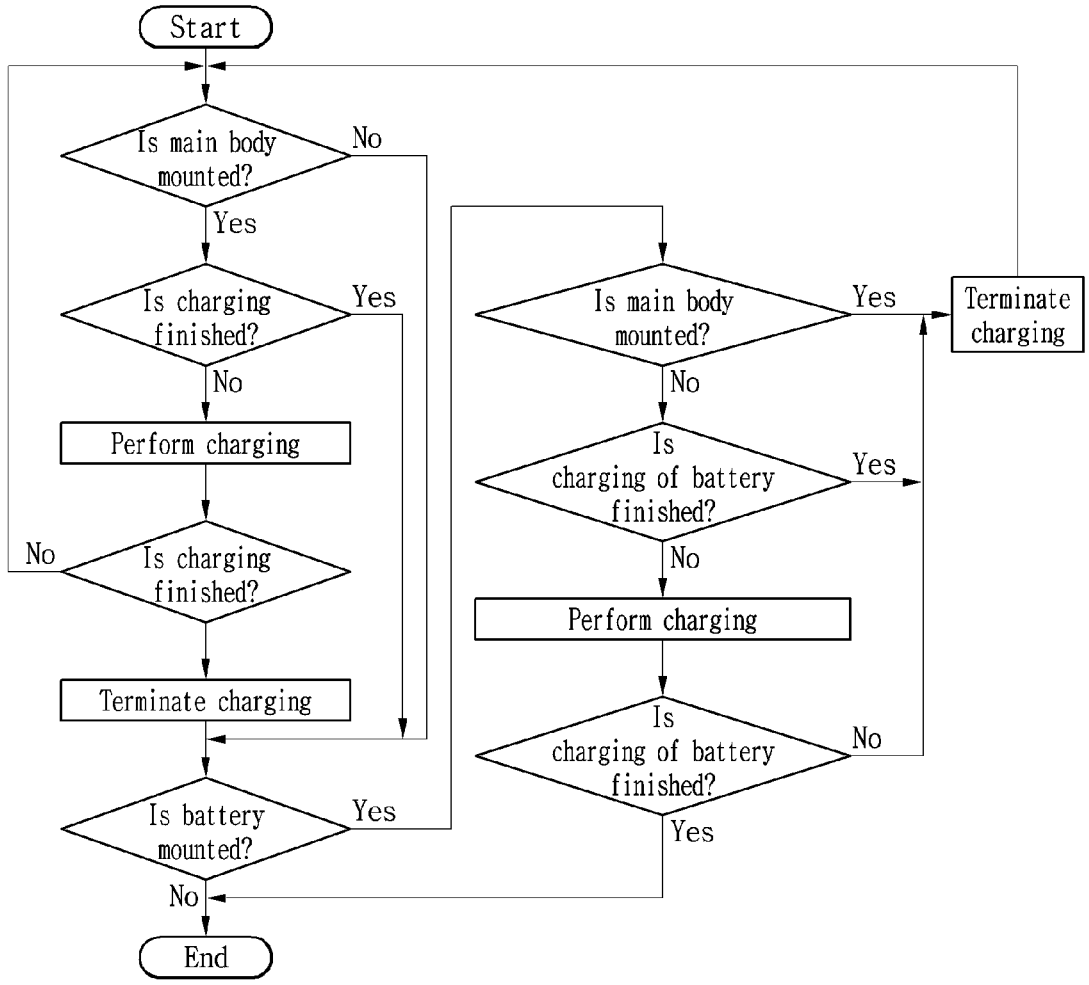
FIG. 10 is a flowchart illustrating an operation of the charging stand of the vacuum cleaner according to an embodiment.

Also, FIG. 10 is a flowchart illustrating a charging operation of the vacuum cleaner according to an embodiment.

Referring to FIGS. 8 through 10, a controller 46 is mounted in the charging stand 40. The controller 46 controls operations of the nozzle support portion 41, the main body support portion 42, and the battery charging portion 43.

That is, the controller 46 controls a charging priority depending on whether the main body 10 is mounted on the nozzle support portion 41 or the main body support portion 42. In detail, when the main body 10 is mounted on the nozzle support portion 41 or the main body support portion 42, the controller 46 controls the charging priority to charge the main body 10 first, and when the charging of the main body 10 is finished, the controller 46 controls the charging priority to charge the battery 34 of the battery charging portion 43.

In addition, when the main body 10 is not mounted on the nozzle support portion 41 or the main body support portion 42, the controller 46 controls the charging priority to charge the battery 34 of the battery charging portion 43.

In other words, the controller 46 controls the charging priority to charge the nozzle support portion 41 or the main body support portion 42 first and to charge the battery charging portion 43.

Thus, the controller 46 controls the charging priority to charge the battery 34 mounted on the battery charging portion 43 when the charging of the main body 10 is finished or the main body 10 is moved to be released from the support of the main body 10.

The controller 46 is connected to the adapter 44 and receives the commercially available power and is connected to the main body support portion 42 and the battery charging portion 43 to perform charging or control the charging priority.

A main body power supply portion 424 and a battery power supply portion 432 are respectively connected to the main body support portion 42 and the battery charging portion 43 and supply power to the main body support portion 42 and the battery charging portion 43.

Referring to FIG. 9, a circuit of the controller 46 is configured to be electrically connected to the terminal portion 423 and the battery terminal so as to control charging operations of the main body 10 and the battery 34.

In detail, the controller 46 may include a charging controller 461 for controlling the charging of the main body 10 and the battery 34, a current detection circuit 462 that determines whether the main body 10 is mounted, and a voltage detection circuit 463 that determines whether the battery 34 is mounted.

Also, the controller 46 may include a charging circuit 464 that determines whether the charging of the main body 10 and the battery 34 is finished.

The charging controller 461 may determine whether the main body 10 is mounted, using signals transmitted from the current detection circuit 462. In detail, when the main body 10 is mounted, the terminal portion 423 is electrically connected to the main body 10, and through this connection, a set current or greater current flows through the current detection circuit 462.

If the set current or greater current flows through the current detection circuit 462, signals are transmitted to the charging controller 461, and the charging controller 461 determines whether the main body 10 is mounted, using the signals received from the current detection circuit 462 so that the main body 10 may be charged.

In one example, if the main body 10 is not mounted on the charging stand 40, a current that is close to 0 amperes flows through the current detection circuit 462, and if the main body 10 is mounted on the charging stand 40, the terminal portion 423 is connected to the current detection circuit 462, and a current that is larger than 0 amperes flows through the current detection circuit 462.

In this case, the current detection circuit 462 transmits signals to the charging controller 461, and the charging controller 461 that receives the signals controls the charging of the main body 10.

In addition, the charging controller 461 may determine whether the battery 34 is mounted on the battery charging portion 43, using the signals transmitted from the voltage detection circuit 463.

In detail, when the battery 34 is mounted on the battery charging portion 43, the battery terminal is electrically connected to the battery 34, and through this connection, a current having a set voltage or greater voltage flows through the voltage detection circuit 463.

If the current having a set voltage or greater voltage flows through the voltage detection circuit 463, signals are transmitted to the charging controller 461, and the charging controller 461 determines whether the battery 34 is mounted, using the signals received from the voltage detection circuit 463 so that the battery 34 may be charged.

In one example, if the battery 34 is not mounted on the battery charging portion 43, a current having a voltage that is close to 0V flows through the voltage detection circuit 463, and if the battery 34 is mounted on the charging stand 40, the battery terminal is connected to the battery 34 so that a current having a voltage of approximately 5V flows through the voltage detection circuit 463.

In this case, the voltage detection circuit 463 transmits signals to the charging controller 461, and the charging controller 461 that receives the signals controls the charging of the battery 34.

Hereinafter, an operation of the charging stand 40 will be described with reference to FIG. 10.

The controller 46 first checks whether the main body 10 is mounted on the charging stand 40. Whether the main body 10 is mounted or not may be determined by the charging controller 461 depending on whether the terminal portion 423 is connected to the main body 10.

If it is determined that the main body 10 is mounted, the controller 46 determines a charging state of the main body 10, and if the charging of the main body 10 is finished, the controller 46 terminates the charging of the main body 10 and performs the charging of the battery charging portion 43.

If the charging of the main body 10 is not finished, the charging of the main body 10 is performed, and if it is checked whether the charging of the main body 10 is finished and the charging of the main body 10 is finished, the charging is terminated, and if the charging of the main body 10 is not finished, it is checked again whether the main body 10 is mounted.

This is to check whether the main body 10 is detached from the charging stand 40.

If the charging of the main body 10 is finished, it is checked whether the battery 34 is mounted on the battery charging portion 43, and when the battery 34 is not mounted on the battery charging portion 43, an operation of the charging stand 40 is terminated.

When the battery 34 is mounted on the battery charging portion 43, it is determined whether the main body 10 is mounted, and when the main body 10 is not mounted, the charging of the battery 34 is performed, and when the main body 10 is mounted, the charging of the battery charging portion 43 is terminated, and the charging of the main body 10 is performed.

If the charging of the battery 34 is finished, the charging of the battery 34 is terminated, and it is checked whether the main body 10 is mounted so that an operation of the charging stand 40 may be terminated, and it is continuously checked whether the main body 10 is mounted, while the charging of the battery 34 is performed.

In this way, it is continuously checked whether the main body 10 is mounted so that the charging priority of the charging stand 40 may be controlled. That is, the charging of the main body 10 is first performed in a state in which the main body 10 is mounted, and the charging of the battery 34 may be performed in a state in which the main body 10 is not mounted.

The operation of the charging stand 40 of the vacuum cleaner will be described with reference to the above configuration.

The user mounts the battery 34 on the charging stand 40 and charges the battery 34 if power of the battery 34 mounted on the auxiliary cleaner 30 is used. In this case, the user mounts the battery 34 in such a way that the main body 10 or the auxiliary cleaner 30 may be supported on the charging stand 40 in a state in which the battery 34 is mounted.

The user moves the main body 10 downward in a state in which the main body 10 is disposed on an upper side of the charging stand 40. If the main body 10 is moved downward, the bottom end of the nozzle assembly 20 is in contact with the top surface of the nozzle support portion 41.

If the main body 10 is continuously moved downward, the bottom end of the nozzle assembly 20 is moved forward along the top surface of the nozzle support portion 41.

If the nozzle assembly 20 is moved toward the front of the nozzle support portion 41 and is in contact with the nozzle stopper 411, forward movement of the nozzle support portion 41 is restricted. Forward movement of the nozzle support portion 41 is restricted, and the main body 10 is moved downward.

The main body 10 is moved downward, and the main body 10 is coupled to the main body coupling portion 422 so that the main body 10 may be stably supported on the charging stand 40.

If the main body 10 is stably supported on the charging stand 40, the controller 46 recognizes a mounting state of the main body 10 and controls the charging priority to perform charging of the main body 10 first.

In this case, if the battery 34 of the main body 10 is not mounted or charging of the battery 34 is finished, the controller 46 controls the charging priority to perform charging of the battery charging portion 43.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vacuum cleaner comprising:

a cleaner main body including a nozzle assembly into which particles are suctioned, and an accommodation portion;

an auxiliary cleaner removably mounted on the accommodation portion, and including suction device that generates suction, a battery to supply power to the suction device, and a collecting portion to collect the suctioned particles; and a charging stand including a support portion that is attached to the cleaner main body, and a battery charging portion to charge a replacement battery, wherein the auxiliary cleaner includes a battery compartment with an opening, the battery or the replacement battery is removably mounted on the battery compartment through the opening, wherein the opening of the battery compartment faces the accommodation portion in a state in which the auxiliary cleaner is mounted on the accommodation portion.

2. The vacuum cleaner of claim 1, wherein the support portion comprises:

a main body support portion to support the cleaner main body; and a nozzle support portion to support the nozzle assembly, wherein a suction portion of the nozzle assembly faces the nozzle support portion in a state in which the nozzle support portion supports the nozzle assembly.

3. The vacuum cleaner of claim 2, wherein the battery charging portion is provided at one side of the main body support portion.

4. The vacuum cleaner of claim 3, further comprising a nozzle stopper to restrict movement of the nozzle assembly, wherein the nozzle stopper is provided at the nozzle support portion.

5. The vacuum cleaner of claim 1, wherein the battery is detached from the auxiliary cleaner and mounted to the battery charging portion to be charged.

6. The vacuum cleaner of claim 1, wherein the battery charging portion comprises a coupling portion to couple with the battery or the replacement battery.

7. The vacuum cleaner of claim 6, wherein the battery charging portion comprises a charge indicator to indicate a charge level of the mounted battery or replacement battery.

8. The vacuum cleaner of claim 1, wherein the charging stand further comprises:

a power supply terminal that is connected to a power supply to supply power to the support portion;

a main body power supply portion to charge the battery of the auxiliary cleaner; and a battery power supply portion connected to the main body power supply portion to charge the battery or the replacement battery in the battery charging portion.

9. The vacuum cleaner of claim 1, wherein the charging stand further comprises a controller to control a charging priority of the battery of the auxiliary cleaner and the battery charging portion.

10. The vacuum cleaner of claim 9, wherein, when the cleaner main body is mounted to the support portion, the controller controls the charging priority to charge the replacement battery mounted to the battery charging portion after the battery of the auxiliary cleaner is charged, and when charging of the battery of the auxiliary cleaner is finished or the cleaner main body is not mounted to the support portion, the controller controls the charging priority to perform charging of the replacement battery mounted to the battery charging portion.

11. The vacuum cleaner of claim 9, wherein the support portion further comprise terminal portions capable of being electrically connected to the cleaner main body when the cleaner main body is supported to the support portion.

12. The vacuum cleaner of claim 11, wherein the controller comprises a detection circuit to determine whether the cleaner main body is mounted to the support body, through connection of the terminal portions; and a charging circuit to charge the battery of the auxiliary cleaner through connection of the terminal portions.

13. The vacuum cleaner of claim 11, wherein the cleaner main body further comprises a battery circuit through which the terminal portions and the battery are electrically connected when the cleaner main body is supported by the support portion.

14. The vacuum cleaner of claim 9, wherein the controller compares a voltage of the battery charging portion with a set voltage and determines whether the battery is mounted to the battery charging portion.

15. A vacuum cleaner comprising:

a cleaner main body including a nozzle assembly into which particles are suctioned, and an accommodation portion;

an auxiliary cleaner removably mounted on the accommodation portion, and including a suction device to generate suction, a first battery to supply power to the suction device, and a collecting portion to collect the suctioned particles; and a charging stand including a support portion that is attached to the cleaner main body, and a battery charging portion to charge a second battery that is replaceable with the first battery, wherein the auxiliary cleaner includes a battery compartment with an opening, the first battery or the second battery is removably mounded on the battery compartment through the opening, wherein the opening of the battery compartment faces the accommodation portion in a state in which the auxiliary cleaner is mounted on the accommodation portion.

16. The vacuum cleaner of claim 15, wherein the second battery is mounted to the auxiliary cleaner, and the first battery is separable from the auxiliary cleaner and mounted to the battery charging portion.

17. The vacuum cleaner of claim 15, wherein, when the cleaner main body is supported by the support portion when the auxiliary cleaner including the first battery is mounted to the cleaner main body, the first battery and the second battery are charged in a predetermined order when the second battery is mounted to the battery charging portion.

18. The vacuum cleaner of claim 17, wherein the second battery is charged after the first battery is first charged.

* * * * *